US012102217B1

(12) United States Patent
Haroun

(10) Patent No.: US 12,102,217 B1
(45) Date of Patent: Oct. 1, 2024

(54) CONVERTIBLE TOTE

(71) Applicant: Amazon Technologies, Inc., Seattle, WA (US)

(72) Inventor: Christopher Steven Haroun, West Hollywood, CA (US)

(73) Assignee: Amazon Technologies, Inc., Seattle, WA (US)

( * ) Notice: Subject to any disclaimer, the term of this patent is extended or adjusted under 35 U.S.C. 154(b) by 154 days.

(21) Appl. No.: 18/066,858

(22) Filed: Dec. 15, 2022

(51) Int. Cl.

| | |
|---|---|
| ***A45F 4/02*** | (2006.01) |
| ***A45C 3/06*** | (2006.01) |
| ***A45F 3/02*** | (2006.01) |
| ***A45F 3/14*** | (2006.01) |

(52) U.S. Cl.
CPC ..... *A45F 4/02* (2013.01); *A45C 3/06* (2013.01); *A45F 3/02* (2013.01); *A45F 3/14* (2013.01); *A45F 2003/142* (2013.01); *A45F 2004/023* (2013.01)

(58) Field of Classification Search
CPC . A45F 4/02; A45F 4/023; A45F 3/047; A45C 9/00; A45C 2009/007
USPC ..... 224/578–580
See application file for complete search history.

(56) References Cited

U.S. PATENT DOCUMENTS

| | | | | |
|---|---|---|---|---|
| 1,735,655 A * | 11/1929 | Pitkin | A45C 3/06 | 150/108 |
| 2,960,137 A * | 11/1960 | Lipsitz | A45C 11/38 | 150/108 |
| 4,679,671 A * | 7/1987 | Kobayashi | A45F 3/04 | 190/115 |
| 5,415,332 A * | 5/1995 | Kliot | A45F 3/02 | 150/108 |
| D752,860 S | 4/2016 | Barillaro | | |
| 10,058,163 B2 | 8/2018 | Mather | | |
| D947,528 S | 4/2022 | Guyon | | |
| 11,969,076 B2 * | 4/2024 | Liesch | A45F 3/04 | |

FOREIGN PATENT DOCUMENTS

WO WO12018148184 A1 8/2018

OTHER PUBLICATIONS

And wander, retrieved on Dec. 7, 2022 at <<https://www.andwander.com/items/bags/5741175403.html?dwvar_5741175403_color=180#start=1>> 6 pages.

(Continued)

*Primary Examiner* — Adam J Waggenspack
(74) *Attorney, Agent, or Firm* — Lee & Hayes, P.C.

(57) ABSTRACT

A convertible tote bag includes a bag body including an upper portion and a lower portion. A handle strap is fixedly anchored at a first anchor point to the lower portion of the bag body, and slidably anchored at a second anchor point to the upper portion of the bag body. The handle strap is slidable between a first position in which a first segment of the handle strap, between the first anchor point and the second anchor point, is cinched against a side of the bag body, and in which a second segment of the handle strap extends above the second anchor point away from the bag body, and a second position in which the first segment of the handle strap and the second segment of the handle strap are pulled below the second anchor point to form a loop off the side of the bag body.

20 Claims, 9 Drawing Sheets

(56) References Cited

OTHER PUBLICATIONS

The North Face Borealis Tote, retrieved from <https://www.thenorthface.com/en-us/bags-and-gear/backpacks-c224451/borealis-tote-pNF0A52SV> on Nov. 29, 2022 (13 pages).
Porter-Yoshida & Co, Mr Porter, Flying Ace 2Way Webbing-Truimmed Nylon Helmet Bag, retrieved on Dec. 7, 2022 on <<https://www.mrporter.com/en-us/mens/product/porter-yoshida-co/accessories/totes/flying-ace-2way-webbing-trimmed-nylon-helmet-bag/1647597284377548>> 3 pages.
The North Face Borealis Tote Review, https://packhacker.com/travel-gear/the-north-face/borealis-tote/, May 25, 2022, 12 pages.

* cited by examiner

CONVERTIBLE TOTE

BACKGROUND

There are many bags having features that facilitate a user to carry a bag in a variety of ways, which may be useful depending on the user's needs, either physically or for sheer preference. For example, a person may prefer a backpack over a bag designed to be carried by hand. In another example, a bag that is heavily laden one day, may be used for a lighter load on another day. In such an example, the user may desire to carry a heavy load with the burden on the shoulders, while a lighter load may be simple enough to carry by hand. In this view, some bags have been designed with multiple sets of fixed, or even detachable, separate sets of handles, straps, harnesses, etc. to provide a user with the choice of carrying the bag according to a personal preference. In general, such bags may ultimately include additional or unnecessary bulk, weight, complexity, and/or clutter.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference number in different figures indicates similar or identical items. The systems depicted in the accompanying figures are not to scale and components within the figures may be depicted not to scale with each other.

DETAILED DESCRIPTION

Overview

This disclosure is directed to convertible totes that may be carried by the user either as a tote (e.g., over one shoulder, by hand, or in the crook of the arm) or as a backpack (e.g., on both of the user's shoulders). Like most bags, the convertible totes include a bag for storing items being carried and handle(s), via which the bag is carried when transported. Beyond this, the convertible tote may be further designed with multiple fashionable and/or stylistic design features to appeal to various different user preferences. For example, a convertible tote bag may include pockets, a series of loops built into the fabric, mesh siding, zippers, colored leather, different types of fabric and materials, structural support elements designed into the structure to appear as decorative aspects, etc. Some of the features mentioned here, in fact, are embodied in the figures, as depicted. Further, the convertible tote may be of any size suitable to be carried by a user, and the tote bag may be formed of different materials, with varying structural characteristics both based on design preference and expected use of the tote. However, the various materials, dimensions, and/or ornamental aspects of a convertible tote are not of primary focus herein, and as such, those elements and aspects are not discussed in any detail. Rather, the following description focuses on the structural features associated with the convertibility of the bag between a tote and backpack.

For the purposes of this description, the body of the bag may be formed by a wide variety of materials that are suitable for the expected loads expected to be carried. The body of the bag may be of a generic form having a closed end and an open (or openable) aperture via which contents may be placed into the bag. The handle(s) may be formed for the bag using elongated continuous sections of material (e.g., strips of leather that may be layered or unlayered; or other durable material such as a length of rope, a composite of one or more materials formed in an elongated shape, etc.). At a very broad level, a handle is provided by connecting each end of the elongated material to the bag to form a loop.

Figure 6:
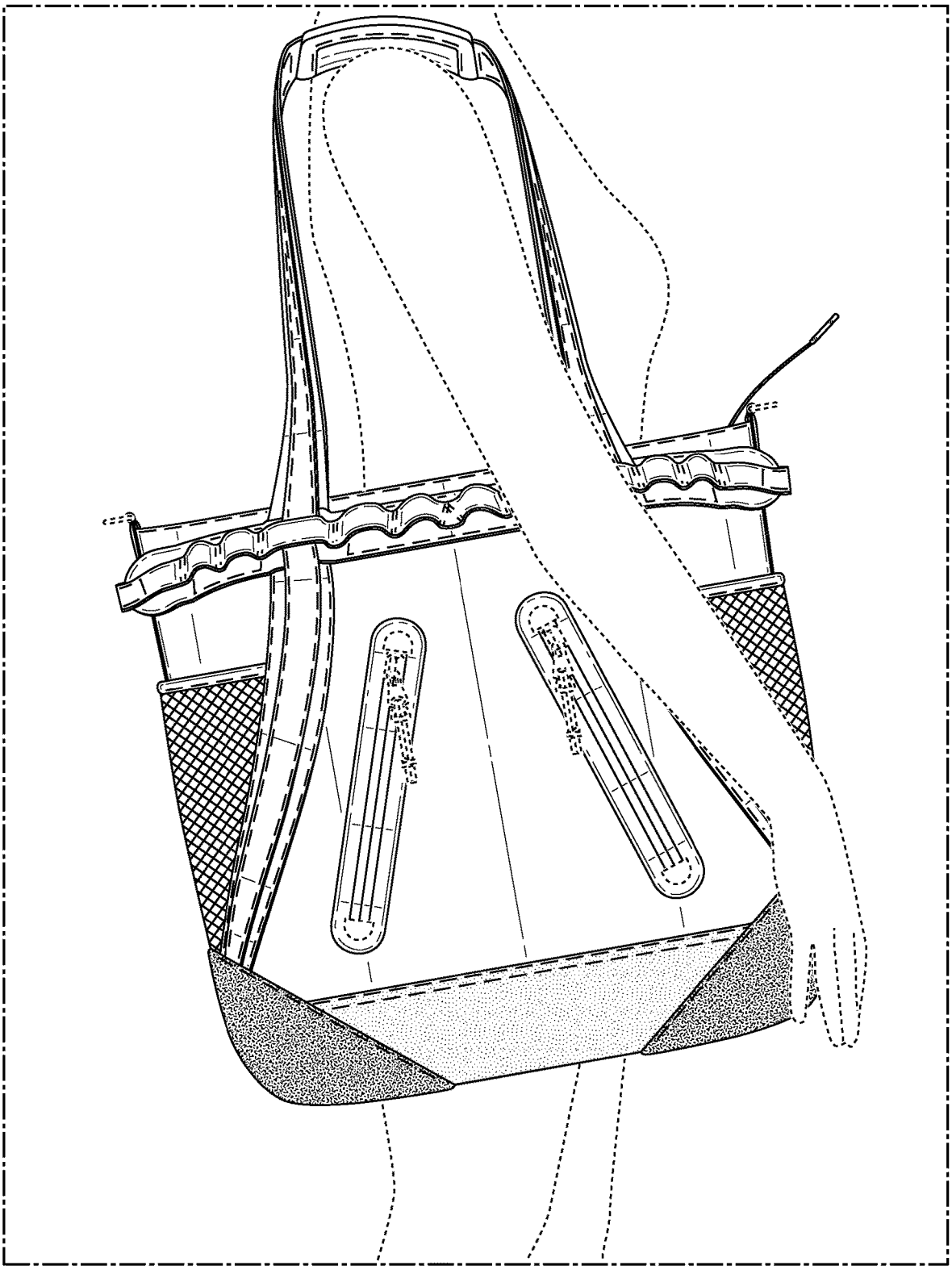
FIG. 6 illustrates a user using the convertible tote of FIG. 1 in a first manner with the handle in the first position.

When the convertible bag is in the tote mode, it is to be understood that a handle of the bag is extended upward forming a loop in a direction above the bag (see, e.g., FIG. 6). As expected, the user may carry the tote bag, for example, by hooking a hand through the loop and grasping the middle of the loop so that the tote bag is supported by the user's hand. Moreover, the bag may also be carried over one shoulder (FIG. 6), by hand (not shown), or in the crook of the arm (not shown). In contrast, when the convertible tote bag is in the backpack mode, it is to be understood that the same handle mentioned above (that was held by the user's hand in the hand carry mode) is displaced in a downward position relative to the position in the hand carry mode (see, e.g., FIG. 7). This downward displacement converts the former single upwardly directed loop into two laterally directed loops, which may be slipped over a user's arms so that the convertible tote bag is carried like a backpack with the load on the user's shoulders. Accordingly, a convertible tote bag may include a displaceable handle.

As indicated above, the convertibility of the tote bag between carry modes is achieved using a single displaceable handle. In an embodiment, the displaceability of the handle is due, at least in part to, the structure of the anchoring points by which the handle is anchored to the bag. In an example, the ends of the handle may be attached to the bag via respective fixed anchors at a first part of the bag and via respective slidable anchors at a second part of the bag. Thus, the tote bag may include a displaceable handle.

Notably, depending on the materials chosen for the bag, the particular placement of the single handle on the body of the bag, and the load carried in the bag, it is understood that, when carried by hand, a bag with a single handle may hang in a manner different than that depicted. For example, the bag may sag on a side opposite the handle. However, it is contemplated that a bag having only a single handle may be covered by the scope of this application.

The present disclosure provides an overall understanding of the principles of the structure, function, and apparatus disclosed herein. One or more examples of the present disclosure are illustrated in the accompanying drawings. Those of ordinary skill in the art will understand that the apparatuses specifically described herein and illustrated in the accompanying drawings are non-limiting embodiments. The features illustrated or described in connection with one embodiment may be combined with the features of other embodiments. Such modifications and variations are intended to be included within the scope of the appended claims.

Figure 1A:
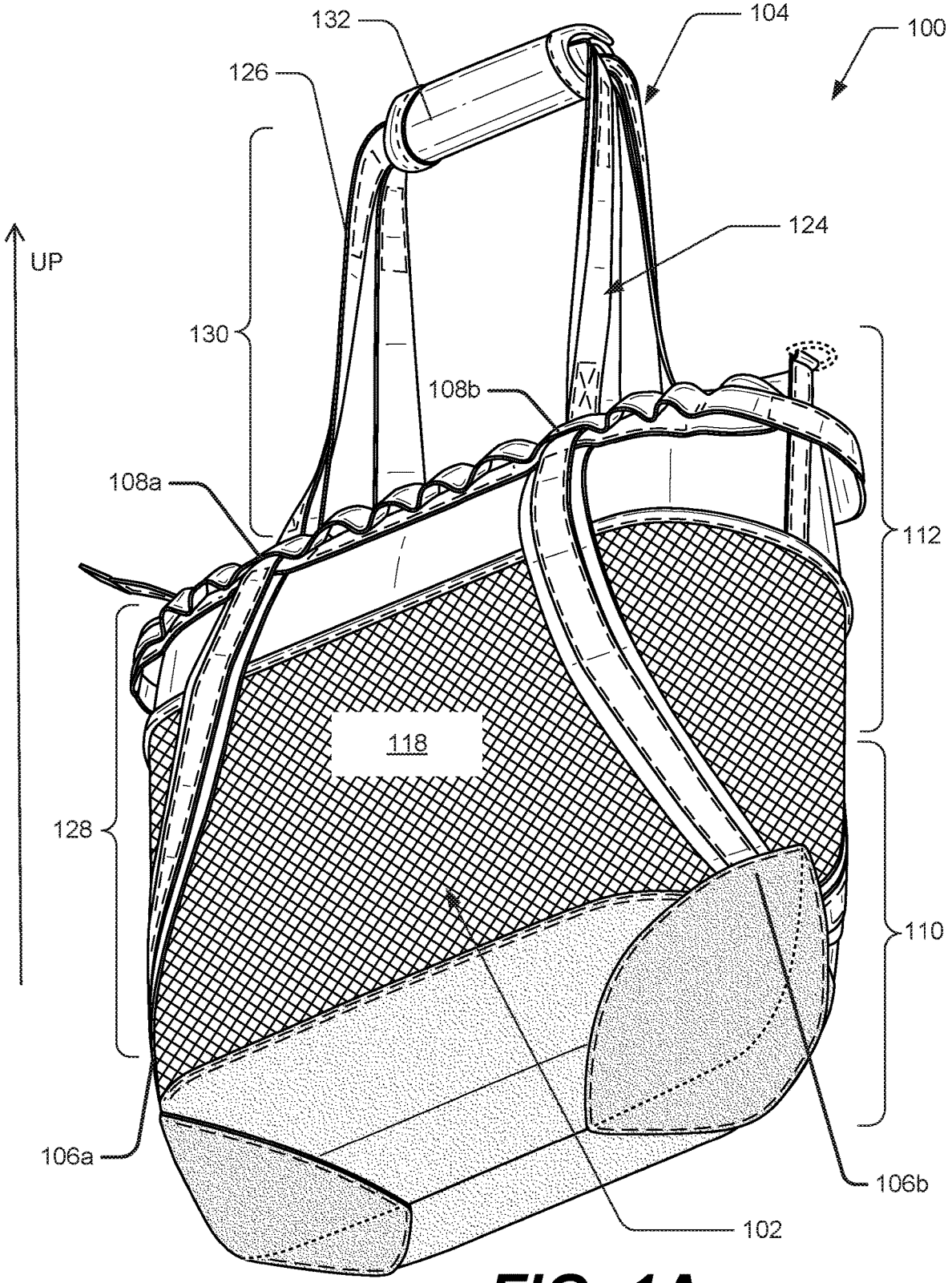
FIG. 1A illustrates a perspective view, from a bottom angle, of the rear of a convertible tote, according to an embodiment of the present disclosure.
Figure 1B:
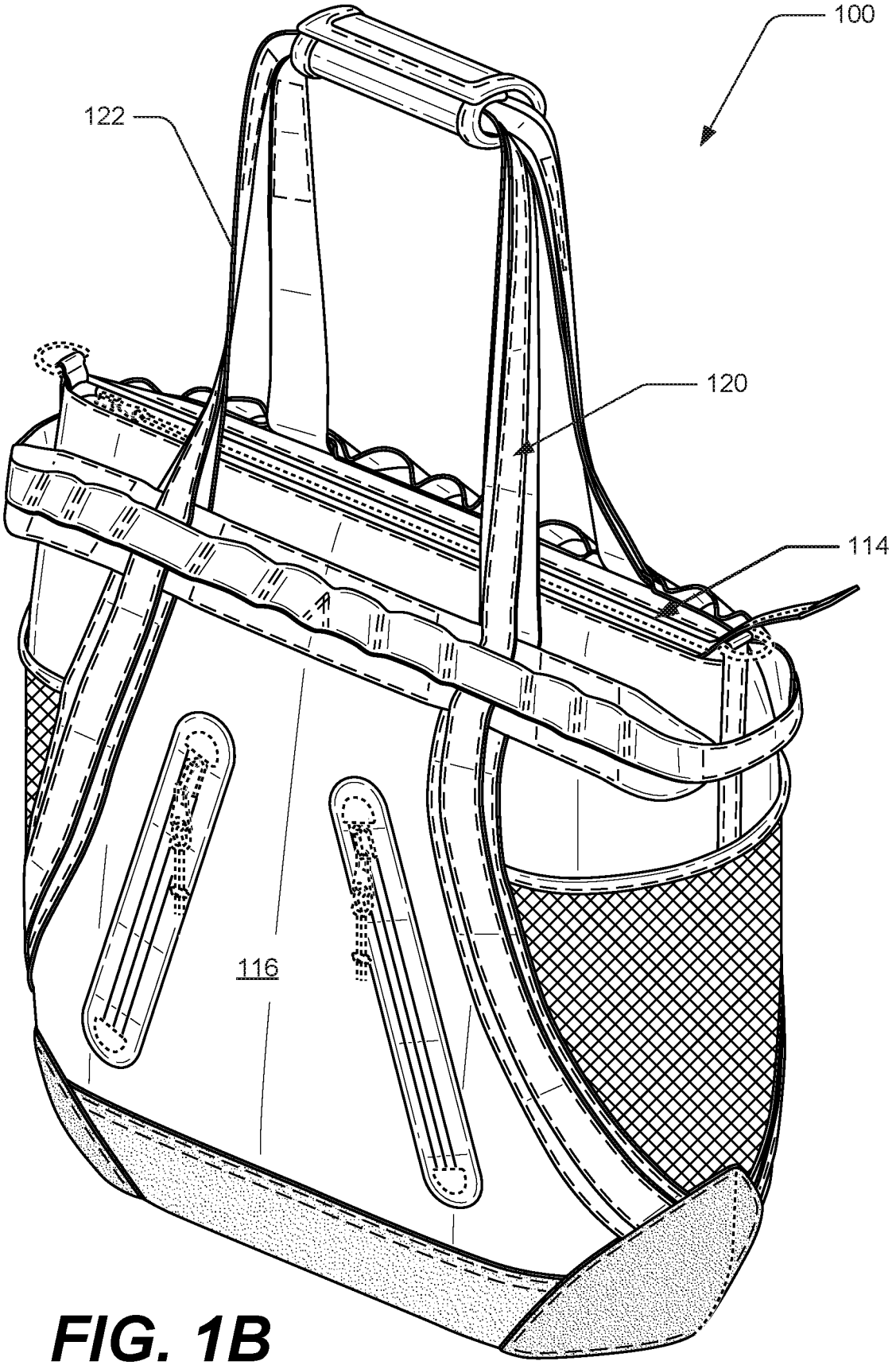
FIG. 1B illustrates a perspective view, from a top angle, of the front of the convertible tote, according to the embodiment of FIG. 1A in the present disclosure.

The figures depict an embodiment of a tote bag with two handles. As shown in FIGS. 1A and 1B, a convertible tote 100 may include a bag body 102 and a pair of handles 104. Using one or both of the handles 104, a user may conveniently and comfortably carry the tote either by hand or, alternatively, as shown in FIG. 6, where the user is shown with both handles over a single shoulder.

As indicated above, one of the pair of handles 104 may be displaceable in some instances. However, it is contemplated that both handles could be displaceable in other instances. A displaceable handle of the pair of handles 104 may be anchored to the bag body 102 via one or more of the first anchor points 106*a*, 106*b* and via one or more of the second anchor points 108*a*, 108*b*. The first anchor points 106*a*, 106*b* may be spaced apart on opposite lateral ends of the bag body 102 and disposed in the lower portion 110 of bag body 102. The second anchor points 108*a*, 108*b* may be spaced apart laterally from each other as well, and are disposed in the upper portion 112 of bag body 102.

The bag body 102 includes a storage aperture 114 (FIG. 1B) that may be closable, for example, using a zipper, snaps, a drawstring, magnets, etc., as desired. Thus, a user may load the bag body 102 with a load via the storage aperture 114, so that the contents rest on a closed end of the convertible tote 100. In an embodiment, the bag body 102 may include features inside the bag body 102 for managing the items stored therein (not shown), e.g., a laptop/mobile device sleeve, padding for devices, sealable containers, waterproof compartments, insulating materials to form a cooler, compartments that are accessible from inside and outside of bag without requiring the user to open the aperture 114. A first portion of an outer surface that spans across the upper portion 112 and the lower portion 110, defines a first side 116 (see FIG. 1B) of the bag body 102. Likewise, a second portion of the outer surface that spans across the upper portion 112 and the lower portion 110 defines a second side 118 (see FIG. 1A) of the bag body 102, which second side 118 is opposite the first side 116.

In an embodiment, a first handle 120 of the handles 104 may form a first carry loop 122 that extends above the upper portion 112 on the first side 116 of the bag body 102. Similarly, when in the tote position, a second handle 124 may form a second carry loop 126 above the upper portion 112 on the second side 118 of the bag body 102. As discussed in more detail below, the second handle 124 is described as a displaceable handle.

Inasmuch as the second handle 124 may be displaceable, ends of the second handle 124 may be fixedly anchored to the lower portion 110 of the bag body 102 at the respective first anchor points 106*a*, 106*b*. Additionally, the second handle 124 may be slidably anchored to the upper portion 112 of the bag body 102 at the respective second anchor points 108*a*, 108*b*.

Anchored as explained here, a user may convert the convertible tote 100 from the tote carry mode to the backpack mode (see FIG. 7) merely by sliding at least a portion of the second handle 124 between the first position (shown in FIGS. 1A, 1B, and 2) and the second position (shown in FIGS. 4 and 5), as described below.

In an embodiment, in the first position (i.e., tote carry mode), laterally-spaced lower segments 128 of the second handle 124 may be cinched against the second side 118 of the bag body 102, and laterally-spaced upper segments 130 of the second handle 124 extend above the respective second anchor points 108*a*, 108*b* away from the upper portion 112 of the bag body. To be clear, the laterally-spaced lower segments 128 of the second handle 124 are considered to be the portions of the second handle 124 that extend between the respective first anchor points 106*a*, 106*b* and the respective second anchor points 108*a*, 108*b*. Thus, the laterally-spaced upper segments 130 are considered to be the portions of the second handle 124 that extend above the respective second anchor points 108*a*, 108*b*. In an embodiment, the lower segments 128 curve to lateral sides of the bag. However, in an embodiment, not shown, the lower segments 128 may be parallel with respect to each other on the bag.

Figure 4:
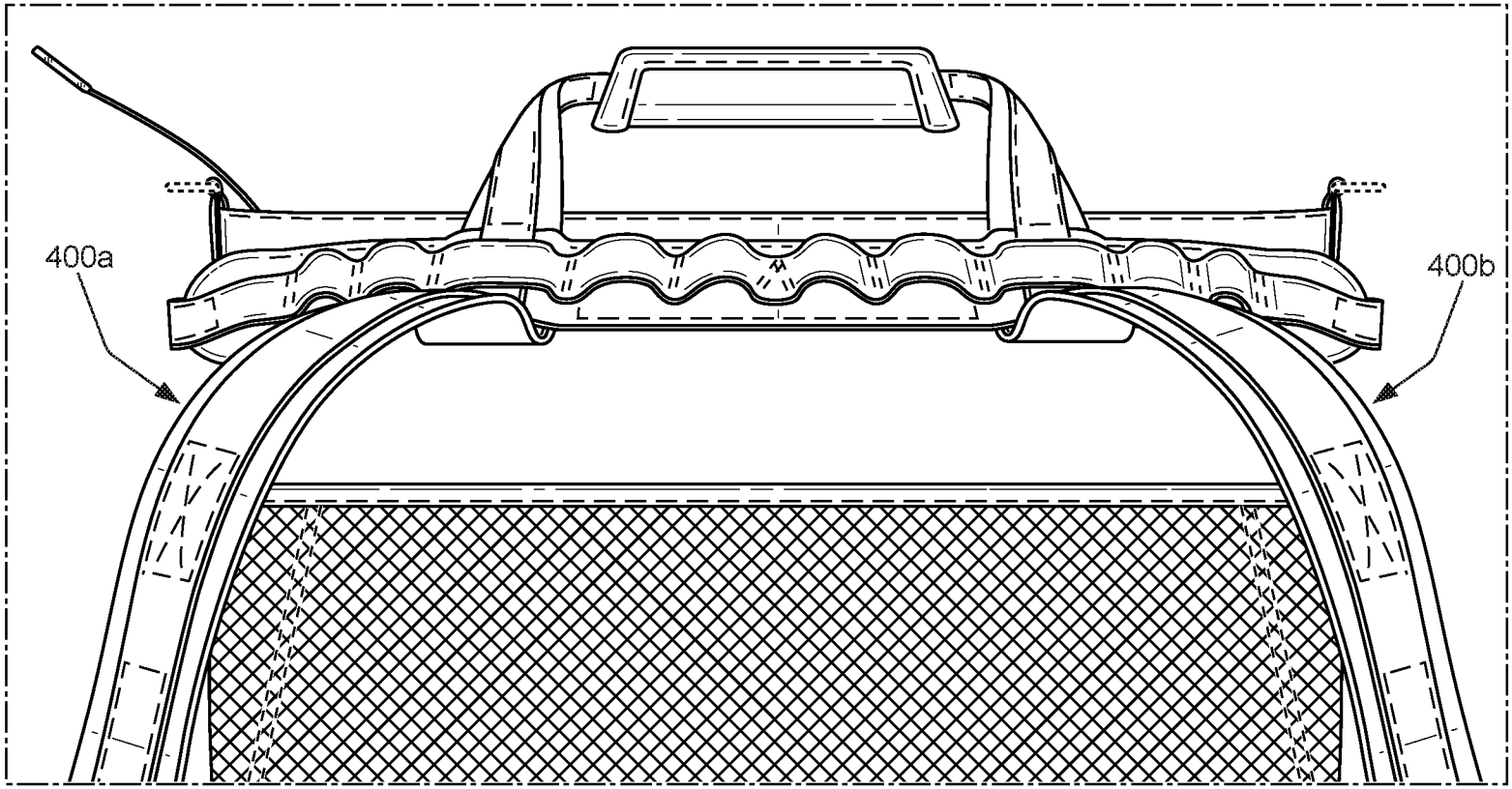
FIG. 4 illustrates a rear partial view of the convertible tote with the handle in the second position, according to the embodiment of FIG. 1A of the present disclosure.
Figure 5:
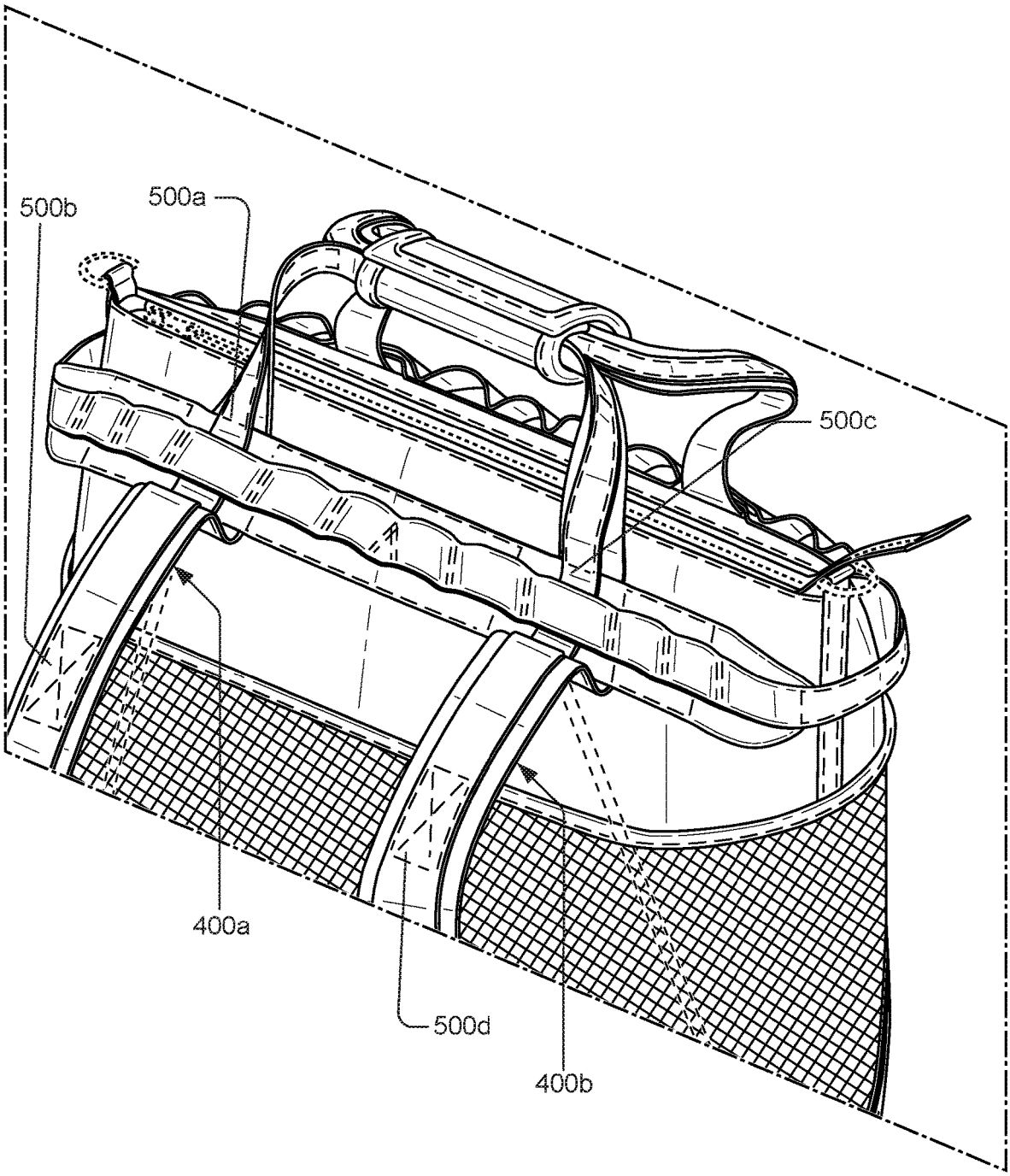
FIG. 5 illustrates a partial perspective view, from a top angle, of the convertible tote with the handle in the second position, according to the embodiment of FIG. 1A of the present disclosure.
Figure 7:
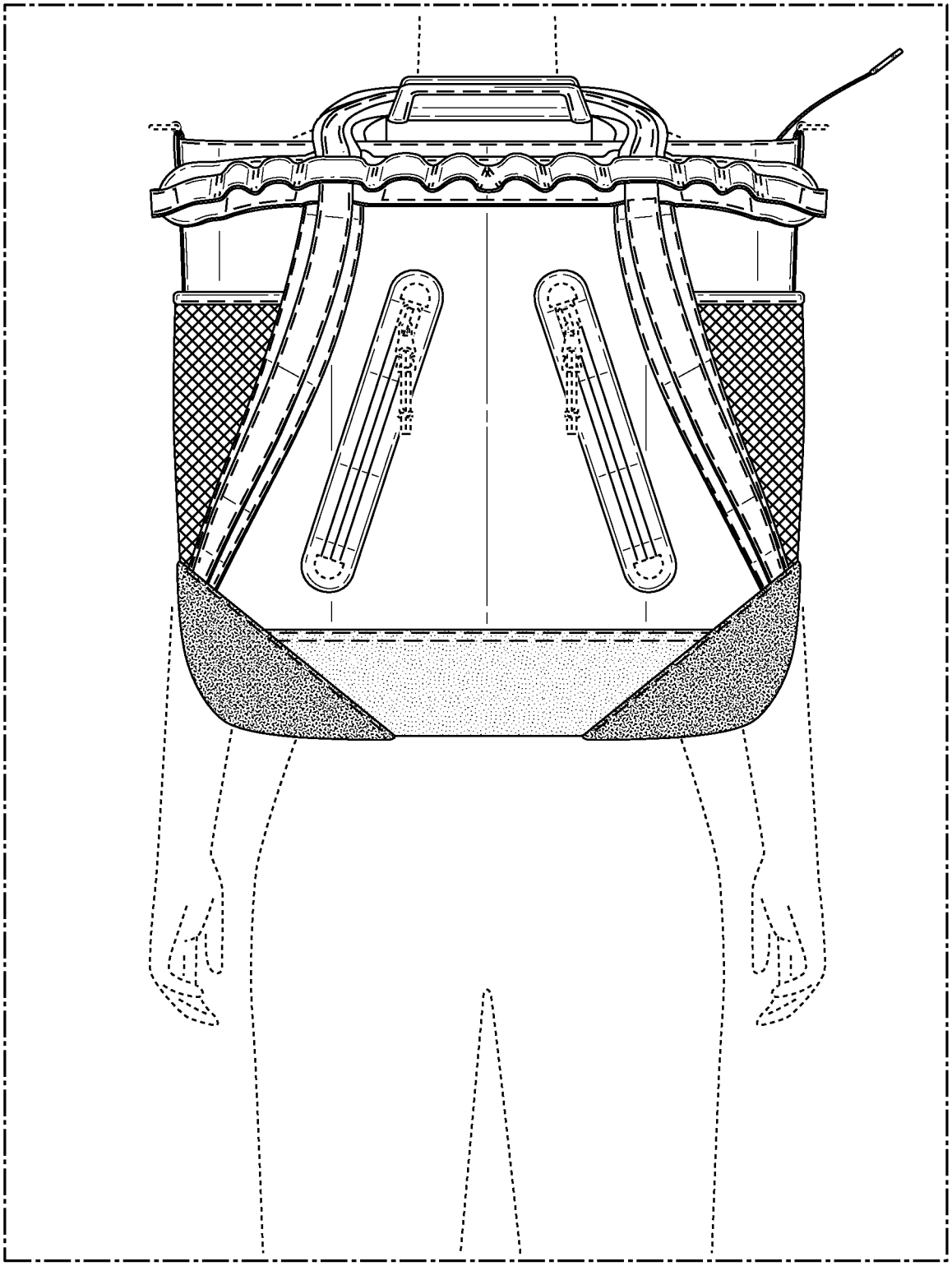
FIG. 7 illustrates a user using the convertible tote of FIG. 1 with the handle in the second position.

In the second position (i.e., backpack carry mode), the second handle 124 is pulled or displaced so that both the laterally-spaced lower segments and the laterally-spaced upper segments of the second handle 124 are pulled below the respective second anchor points 108*a*, 108*b* and away from the second side 118 of the bag body 102, thereby forming a pair of shoulder-carry loops 400*a*, 400*b*, as seen in FIGS. 4 and 5, and for use when wearing on the shoulders as a backpack, as seen in FIG. 7.

In an embodiment, a handle clasp 132 may assist a user in grasping the convertible tote 100. For example, the handle clasp 132 may facilitate keeping the first handle 120 and the second handle 124 united to minimize sagging of the bag body 102 and/or to secure the first handle 120 in a close position when the convertible tote 100 is in the backpack mode.

Figure 2:
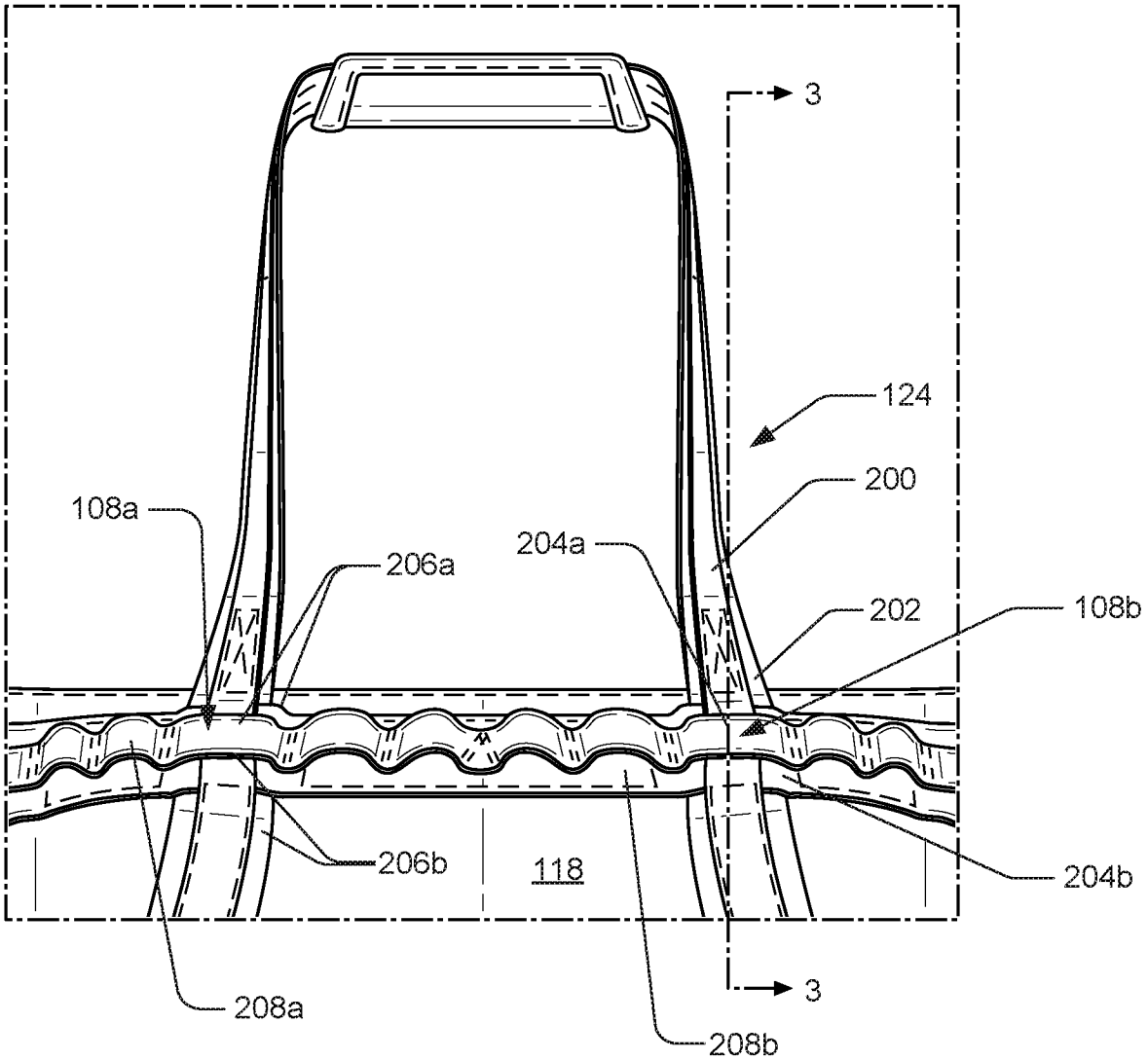
FIG. 2 illustrates a rear partial view of the convertible tote with the handle in the first position, according to the embodiment of FIG. 1A of the present disclosure.
Figure 3:
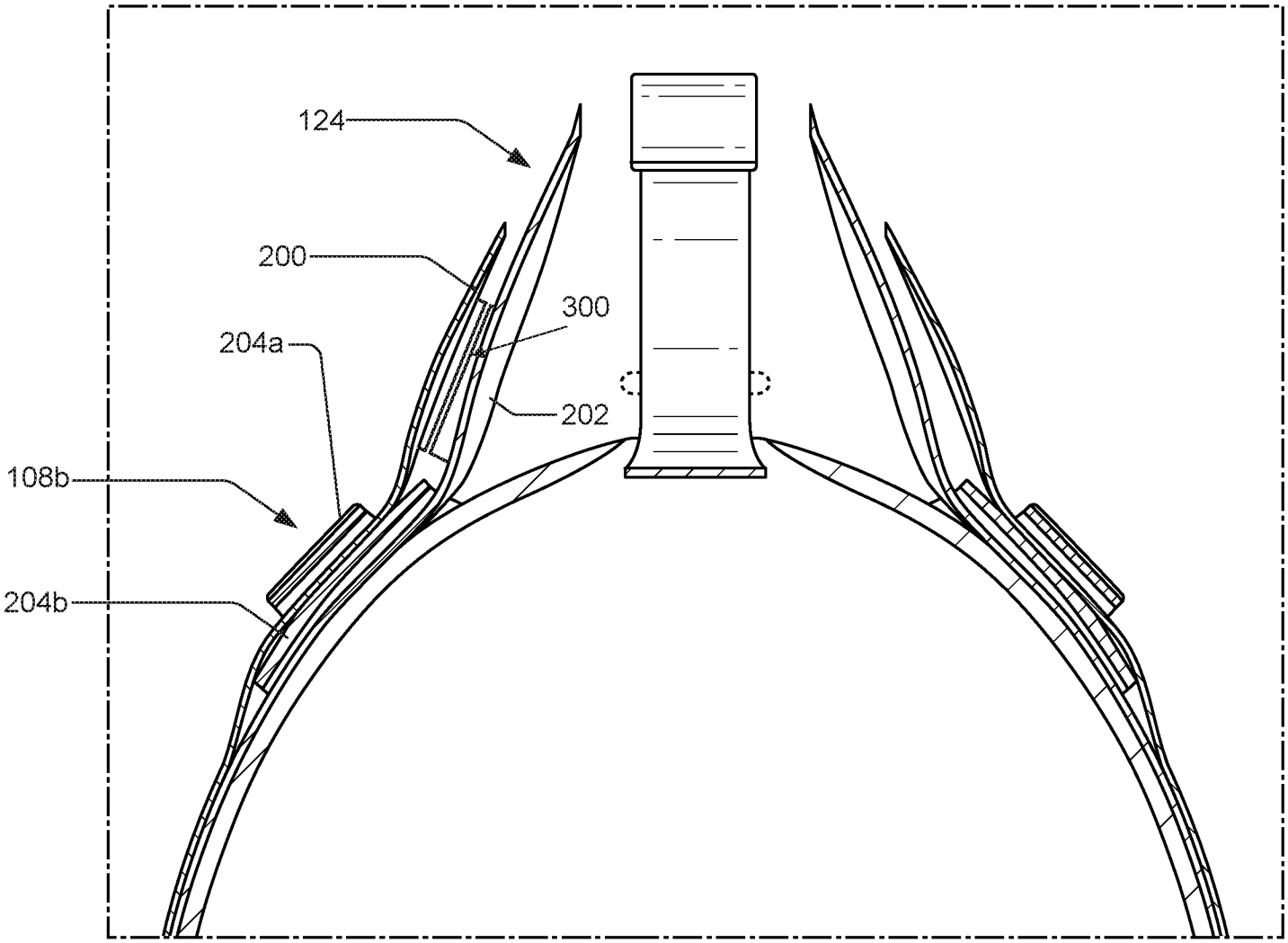
FIG. 3 illustrates a cross-sectional view of the convertible tote along line 3-3 in FIG. 2, according to the embodiment of FIG. 1A of the present disclosure.

In an embodiment, the second handle 124 may include a pair of overlapped straps 200, 202 (FIG. 2). Each of the overlapped straps 200, 202 may be further independently slidably anchored to bag body 102 via interleaving the overlapped straps 200, 202 with overlapping second anchor points 204*a*, 204*b*. That is, second anchor point 204*b* is attached to the second side 118 of the bag body 102, and second anchor point 204*a* is attached to second anchor point 204*b*, in a stacked arrangement with the overlapped straps 200, 202. Note that the interleaving and stacked arrangement is shown from a cross-sectional perspective in FIG. 3. A schematic representation of a slide stop member 300 is also shown in FIG. 3, and further reference to the slide stop members is described hereinafter with respect to FIG. 5.

Moreover, to prevent lateral movement of the straps 200, 202, the respective second anchor points 204*a*, 204*b* may be stitched on each lateral side of the overlapped straps 200, 202. In other potential embodiments, adjustable fasteners (e.g., hook and loop) sections may be used instead of stitches to allow the user to 1) select straps of varying width to us across their shoulders, e.g., as in FIG. 7, as well as 2) adjust the straps closer to each respective lateral edge of bag body 102. In an embodiment using the interleaved straps, a possible advantage of the interleaved construction is that the interleaving better distributes the load when worn by the user in backpack mode. This load distribution may help improve durability of the bag and may also increase user comfort by (1) helping avoid pinching the user's skin in the shoulder region, and (2) better distributing the load along the length of the straps. Further, instead of using a rigid metal or plastic material (e.g., D-rings) the flexible interleaved construction helps improve comfort by preventing the rigid material from digging into the user's shoulder or back. Additionally and/or alternatively, though not shown, it is contemplated that the second handle 124 may be formed as a singular strap of material.

In an embodiment, the first anchor points 106*a*, 106*b* may attach the ends of the second handle 124 to the bag body 102 in a non-removable (or permanent) manner via one or more of a stitching, an adhesive, and/or a cover piece that secures the end of the second handle 124 to the body bag 102. Alternatively, the cover piece may be removable to adjust or even swap out the straps. In an embodiment, the second anchor points 108*a*, 108*b* may include a pair of vertically-spaced, horizontally-extending slits 206*a*, 206*b*. The laterally-spaced upper segments of the second handle 124 are disposed to extend through the slits 206*a*, 206*b* and are then slidably anchored in the vertical direction.

In an embodiment, the slits 206*a*, 206*b* of the second anchor point 108*a*, for example, may be formed either directly into a side surface of the bag body 102 (not shown). Alternatively, as shown, the convertible tote 100 may further include one or more strips of material 208*a*, 208*b* attached to the upper portion 112 of the bag body 102 in a laterally extending direction such that the one or more strips of material 208*a*, 208*b* cross over the location for the second anchor points 108*a*, 108*b*. At the location of the second anchor points 108*a*, 108*b*, the one or more strips of material 208*a*, 208*b* may remain unattached from the surface of the bag body 102, at an upper edge and a lower edge of the one or more strips of material 208*a*, 208*b*. By leaving the one or more strips of material 208*a*, 208*b*, unattached for a short gap, the respective pairs of slits 206*a*, 206*b* are formed, and the respective laterally-spaced upper segments of the second handle 124 may pass through the slits 206*a*, 206*b* to be slidable in the slidable or vertical direction.

In an embodiment, the convertible tote 100 may include one or more slide stop members 500*a*, 500*b*, 500*c*, 500*d* disposed on one or more portions of the second handle 124. The slide stop members 500*a*, 500*b*, 500*c*, 500*d* are also visible in FIGS. 2 and 3. For example, slide stop member 500*a* and slide stop member 500*b* may be found on one of the laterally-spaced upper segments of the second handle 124 such that, when the second handle 124 is in the second position (i.e., backpack mode), the slide stop members 500*a*, 500*b* may prevent the second handle 124 from undesired sliding up through the second anchor point 108*a*. In an embodiment, the slide stop members 500*a*, 500*b*, 500*c*, 500*d* may include one of: a snap button connection, a stitch, a hook and loop connection, a pair of magnets (permanent magnets or electromagnets), or a clip connection. For example, slide stop members 500*a*, 500*c* may, respectively, be formed as stitches that pin overlapped straps 200, 202 together tightly, while slide stop members 500*b*, 500*d* may, respectively, be formed as hook and loop connections between overlapped straps 200, 202. For example, the loop material may be attached to one of the overlapped straps 200, 202 while the hook material is attached to the other one of the overlapped straps 200, 202, such that the hook and loop materials face each other between the overlapped straps 200, 202, and may thus be removably secured to one another.

Alternatively, in an embodiment not shown, slide stop members 500*a*, 500*c* may, respectively, be formed using hook and loop connections located at different positions along 200, 202, respectively, so that the user may select a desired length of shoulder loops when in backpack mode. This, allows, for example the user to select desired resting positions on their back based on the weight of the contents in the bag and also allows the bag to accommodate users having different torso sizes and shapes. Likewise, multiple lower slide stop members (e.g., 500*b*, 500*d*) may be implemented to allow the user to select a particular desired length of the second carry loop 126 when in tote mode.

In practical use, a user may convert the bag 100 from the tote mode to the backpack mode as follows. A user may separate the slide stop members (e.g., 300, 500*b*, 500*d*) on the second side 118 of the bag 100 by pulling apart the overlapping straps 200, 202 from each other above the respective second anchor points 204*a*, 204*b*, on each lateral side of the second handle 124. Once separated, the user may pull the lower segments 128 of the second handle 124 away from the second side 118 of the bag body 102. In doing so, the upper segments 120 of the second handle 124 will slide downward through the respective second anchor points 204*a*, 204*b* until a desired shoulder length of the straps is formed for the backpack use, but not farther than the slide stop members 500*a*, 500*c*, which prevent uneven use of the second handle 124, and maintain a smaller second carry loop 126. The user may further rejoin the slide stop members 500*b*, 500*d* to prevent the second handle 124 from sliding back into the tote mode, and simultaneously prevent the straps from pinching a user's shoulders when wearing in the backpack mode.

To return the bag 100 to the tote mode, the above steps may be performed in reverse.

Figure 8:
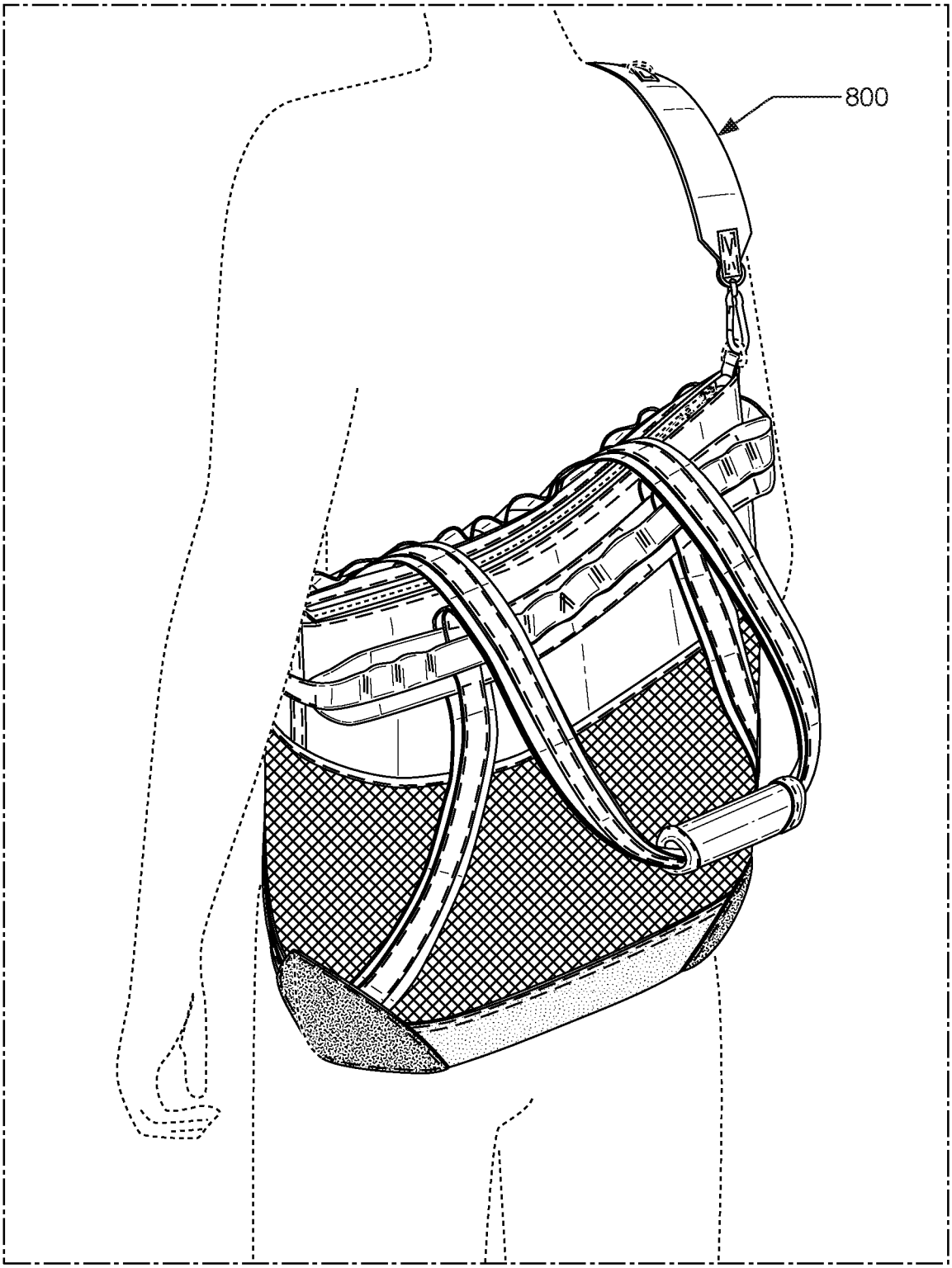
FIG. 8 illustrates a user using the convertible tote of FIG. 1 in a second manner with the handle in the first position.

While FIG. 8 depicts a user carrying a convertible tote in a manner that does not use the handles 104, it is shown to exemplify the multiple uses that the bag embodies. Thus, FIG. 8 depicts that a convertible tote like that disclosed herein may further include a cross-body carry strap 800 which a user might place over the head and shoulders in a side or back carry style. The cross-body carry strap 800 may attach to top corners of the bag via a hook and buckle, carabiner, or other fastener mechanism.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Although the application describes embodiments having specific structural features, it is to be understood that the claims are not necessarily limited to the specific features described. Rather, the specific features are merely illustrative of some embodiments that fall within the scope of the claims of the application.

What is claimed is:

1. A convertible bag comprising:

a bag body including:

an upper portion, a storage aperture located in the upper portion, a lower portion having a closed end, a first portion of an outer surface that spans across the upper portion and the lower portion, defining a first side of the bag body, and a second portion of the outer surface that spans across the upper portion and the lower portion, defining a second side of the bag body, the second side being opposite the first side;

a first lateral loop of material surrounding the upper portion of the bag body;

a second lateral loop of material surrounding the upper portion of the bag body, the second lateral loop overlapping the first lateral loop;

a first handle connected to the bag body to form a first carry loop that extends above the upper portion on the first side of the bag body;

a second handle connected to the bag body to form a second carry loop that extends above the upper portion on the second side of the bag body, the second handle including two overlapping straps, and the second handle being:

fixedly anchored to the lower portion of the bag body at respective first anchor points that are spaced apart on opposite lateral ends of the bag body, and slidably anchored to the upper portion of the bag body at respective second anchor points, formed by the overlapping of the second lateral loop on the first lateral loop, the second anchor points being spaced apart laterally from each other, the two overlapping straps being interleaved with the first lateral loop and of the second lateral loop at the respective second anchor points, and whereby the second handle is slidable to be positioned in:

a first position in which:

laterally-spaced lower segments of the second handle are cinched against the second side of the bag body between the respective first anchor points and the respective second anchor points, and laterally-spaced upper segments of the second handle extend above the respective second anchor points away from the upper portion of the bag body, or a second position in which both the laterally-spaced lower segments and the laterally-spaced upper segments are pulled below the respective second anchor points and away from the second side of the bag body to form a pair of shoulder-carry loops; and a slide stop member disposed along the respective laterally-spaced upper segments of the second handle such that, when the second handle is in the second position, the slide stop member is between the first anchor points and the second anchor points and thereby prevents the second handle from sliding up through the second anchor points.

2. The convertible bag of claim 1, wherein the second handle includes a pair of overlapped straps, each strap being independently slidably anchored via overlapping second anchor points.

3. The convertible bag of claim 1, wherein the second handle includes a singular strap, opposite ends of which pass through the respective second anchor points.

4. The convertible bag of claim 1, wherein each of the second anchor points includes a pair of vertically-spaced, horizontally-extending slits, whereby the respective laterally-spaced upper segments of the second handle extend through the slits to be slidable in the vertical direction.

5. The convertible bag of claim 1, wherein, at the crossing of each of the second anchor points, the first lateral loop is unattached from a surface of the bag body at an upper edge and a lower edge of the strip, providing respective pairs of vertically-spaced, horizontally-extending slits, through which one of the two overlapping straps of the second handle extends to be slidable in the vertical direction.

6. The convertible bag of claim 1, further comprising a cross-body carry strap that attaches to upper corners of the bag body.

7. The convertible bag of claim 6, wherein the slide stop member includes one of: a snap button connection, a hook and loop connection, a magnetic connection, or a clip connection.

8. A convertible bag comprising:

a bag body including:

a storage aperture in an upper portion thereof, and a closed end at a lower portion thereof;

a handle strap including two overlapping straps, and the handle strap being:

fixedly anchored to the lower portion of the bag body at a first anchor point, and slidably anchored to the upper portion of the bag body at a second anchor point, the two overlapping straps being interleaved with material of the second anchor point, and whereby the handle strap is slidable between:

a first position in which:

a lower segment of the handle strap, between the first anchor point and the second anchor point, is cinched against a side of the bag body, and an upper segment of the handle strap extends above the second anchor point away from the bag body, and a second position in which the lower segment of the handle strap and the upper segment of the handle strap are pulled below the second anchor point to form a loop off the side of the bag body.

9. The convertible bag of claim 8, wherein each of the overlapped straps is independently slidably anchored via overlapping second anchor points.

10. The convertible bag of claim 8, wherein the handle strap is on a side of the bag body and extends through the second anchor point and forms a loop above the upper portion of the bag body for hand-carrying.

11. The convertible bag of claim 8, wherein the second anchor point includes a pair of vertically-spaced, horizontally-extending slits, whereby the upper segment of the handle strap extends through the slits to be slidable in the vertical direction.

12. The convertible bag of claim 8, further comprising a strip of material attached to the upper portion of the bag body in a laterally extending direction, the strip crossing over the second anchor point, wherein, at the crossing of the second anchor point, the strip is unattached from a surface of the bag body at an upper edge and a lower edge of the strip, providing a pair of vertically-spaced, horizontally-extending slits, through which the laterally-spaced upper segment of the handle strap extends to be slidable in the vertical direction.

13. The convertible bag of claim 8, further comprising a slide stop member disposed along the laterally-spaced upper segment of the handle strap such that, when the handle strap is in the second position, the slide stop member prevents the handle strap from sliding up through the second anchor point.

14. The convertible bag of claim 13, wherein the slide stop member includes one of: a snap button connection, a hook and loop connection, or a clip connection.

15. A convertible bag comprising:

a bag body including:

an upper portion, a storage aperture located in the upper portion, a lower portion having a closed end, and an outer surface that spans across the upper portion and the lower portion on a side of the bag body;

a handle connected to the bag body to form a hand-carry loop that extends above the upper portion on the side of the bag body, the handle being:

fixedly anchored to the lower portion of the bag body at respective first anchor points that are spaced apart on opposite lateral ends of the bag body, and slidably anchored to the upper portion of the bag body at respective second anchor points that are spaced apart laterally from each other, whereby the handle is slidable between:

a first position in which:

laterally-spaced lower segments of the handle are cinched against the side of the bag body between the respective first anchor points and the respective second anchor points, and laterally-spaced upper segments of the second handle are pulled above the respective second anchor points away from the upper portion of the bag body, and a second position in which both the laterally-spaced lower segments and the laterally-spaced upper segments are pulled below the respective second anchor points and away from the second side of the bag body to form respective shoulder-carry loops; and a slide stop member disposed along the respective laterally-spaced upper segments of the handle such that, when the handle is in the second position, the slide stop member is between the first anchor points and the second anchor points and thereby prevents the handle from sliding up through the second anchor points.

16. The convertible bag of claim 15, wherein the handle includes a pair of overlapped straps, each strap being independently slidably anchored via overlapping second anchor points.

17. The convertible bag of claim 15, wherein the handle includes a singular strap, opposite ends of which pass through the respective second anchor points.

18. The convertible bag of claim 15, wherein each of the second anchor points includes a pair of vertically-spaced, horizontally-extending slits, whereby the respective laterally-spaced upper segments of the handle extend through the slits to be slidable in the vertical direction.

19. The convertible bag of claim 15, further comprising a strip of material attached to the upper portion of the bag body in a laterally extending direction, the strip crossing over the second anchor points, wherein, at the crossing of each of the second anchor points, the strip is unattached from a surface of the bag body at an upper edge and a lower edge of the strip, providing respective pairs of vertically-spaced, horizontally-extending slits, through which the respective laterally-spaced upper segments of the second handle extend to be slidable in the vertical direction.

20. The convertible bag of claim 15, further comprising a cross-body carry strap that attaches to upper corners of the bag body.

* * * * *